US006889773B2

(12) United States Patent
Hanratty

(10) Patent No.: US 6,889,773 B2
(45) Date of Patent: May 10, 2005

(54) FIRE FIGHTING ADAPTER FOR CONVERTING A CONVENTIONAL BACK PACK BLOWER INTO A WATER AND FOAM FIRE FIGHTER

(75) Inventor: Michael P. Hanratty, Yaphank, NY (US)

(73) Assignee: Hanratty Associates, LLC, Shirley, NY (US)

( * ) Notice: Subject to any disclaimer, the term of this patent is extended or adjusted under 35 U.S.C. 154(b) by 153 days.

(21) Appl. No.: 10/315,314

(22) Filed: Dec. 9, 2002

(65) Prior Publication Data

US 2004/0216896 A1 Nov. 4, 2004

(51) Int. Cl.[7] ..... A62C 35/00

(52) U.S. Cl. ..... 169/14; 169/15; 239/152; 239/154; 239/289; 239/310; 239/318; 239/432; 239/433; 239/590

(58) Field of Search ..... 239/128, 129, 239/152–154, 419, 419.3, 428, 432, 289, 433, 525, 590, 590.5, 310, 318; 169/14, 15, 24

(56) References Cited

U.S. PATENT DOCUMENTS

| | | | | |
|---|---|---|---|---|
| 1,986,407 A | * | 1/1935 | Parker | 239/153 |
| 2,275,691 A | * | 3/1942 | Simanton | 239/432 |
| 3,223,286 A | * | 12/1965 | Sawyer | 239/654 |
| 3,393,745 A | | 7/1968 | Durstewitz | |
| 3,424,250 A | | 1/1969 | Thomae | |
| 3,607,779 A | | 9/1971 | King et al. | |
| 3,780,812 A | | 12/1973 | Lambert | |
| 4,186,772 A | | 2/1980 | Handleman | |
| 4,993,639 A | * | 2/1991 | Hata | 239/289 |
| 5,190,217 A | * | 3/1993 | Black et al. | 239/154 |
| 5,240,186 A | * | 8/1993 | Dobbins et al. | 239/154 |
| 5,337,830 A | | 8/1994 | Bowman | |
| 5,445,226 A | * | 8/1995 | Scott et al. | 169/15 |
| 5,787,989 A | | 8/1998 | Elmenhorst | |
| 6,267,183 B1 | | 7/2001 | Smagac | |

FOREIGN PATENT DOCUMENTS

| | | |
|---|---|---|
| EP | 0608140 | 7/1994 |
| FR | 2543840 | 10/1984 |

OTHER PUBLICATIONS

PCT International Search Report dated Sep. 24, 2003.

* cited by examiner

*Primary Examiner*—Steven J. Ganey
(74) *Attorney, Agent, or Firm*—McCarter & English, LLP

(57) ABSTRACT

A fire fighting adapter that converts a conventional back pack blower, which has a discharge tube with a free end through which blown air is provided, into a water and foam fire fighter. The adapter includes a housing and a diffuser unit. The housing attaches to, and communicates with, the free end of the discharge tube of the conventional back pack blower to receive the blown air therefrom. The diffuser unit is contained in the housing, and diffuses the water and the foam to engage with the blown air from the free end of the discharge tube of the conventional back pack blower so as to be propelled by the blown air out of the housing.

22 Claims, 2 Drawing Sheets

FIRE FIGHTING ADAPTER FOR CONVERTING A CONVENTIONAL BACK PACK BLOWER INTO A WATER AND FOAM FIRE FIGHTER

BACKGROUND OF THE INVENTION

1. Field of the Invention

The present invention relates to a fire fighting adapter. More particularly, the present invention relates to a fire fighting adapter for converting a conventional back pack blower into a water and foam fire fighter.

2. Description of the Prior Art

Numerous innovations for foam generators have been provided in the prior art that will be described. Even though these innovations may be suitable for the specific individual purposes to which they address, however, they differ from the present invention.

A FIRST EXAMPLE, U.S. Pat. No. 3,393,745 to Durstewitz teaches fire-fighting foam generating apparatus, and, more particularly to such apparatus which includes a centrifugal fan, a cylindrical foam forming net surrounding the fan, a source of foam producing solution under pressure, and a plurality of reaction nozzles mounted on the fan rotor for spraying the solution onto the net and for driving the fan rotor by the reaction forces thus produced to pump air outwardly through the net to generate high expansion foam.

A SECOND EXAMPLE, U.S. Pat. No. 3,424,250 to Thomas teaches an apparatus for entraining air in a mixture of water and detergent compound to form a foam and then entraining further air in the foam to provide a high expansion foam for use in fire fighting.

A THIRD EXAMPLE, U.S. Pat. No. 3,607,779 to King et al. teaches a tubular housing with a rear inlet and a front end outlet that has a foraminous cover over its front end. A shaft extends lengthwise of the inside of the housing and is rotatably supported. It is driven by a water turbine on its front end, the turbine having an inlet for water under pressure and a central front outlet that delivers the water to a forwardly directed nozzle connected to the turbine. Rigidly mounted on the shaft behind the turbine is a fan for blowing air through the housing from back to front. Also mounted on the shaft is a pump for delivering foaming solution to the rear end of the nozzle to mix with the water from the turbine outlet.

A FOURTH EXAMPLE, U.S. Pat. No. 3,780,812 to Lambert teaches a fire protection method and apparatus for generating a high expansion foam. The method includes fluidizing the foams by wetting. The apparatus includes a housing having a source of foam solution under pressure and a source of water under pressure. The housing includes a fan and a perforated member. The fan is positioned in the housing to provide air flow across the perforated member which is wetted by the foam solution to produce high expansion foam bubbles. The fan is driven by a plurality of nozzles mounted both for discharging the water under pressure and for wetting the foam bubbles.

A FIFTH EXAMPLE, U.S. Pat. No. 5,337,830 to Bowman teaches a system for generating fire-fighting foam whereby a foam-forming chemical is mixed with water and air to form foam. The foam is pressurized preferably by the provision of pressurized air to force the foam out of a duct within which the foam is formed and to direct the foam at the seat of the fire or to the site to be protected against fire. A metal mesh is rotatable and preferably helical with respect to the direction of travel of the foam which acts as a catalytic agent and helps to clear foam from the duct within which the foam forms.

A SIXTH EXAMPLE, U.S. Pat. No. 5,787,989 to Elmenhorst teaches a fan casing and a fan which are operated by a reaction jet motor. The reaction jet motor has nozzles and is connected to a liquid under pressure, usually water with a foaming agent added. When the liquid is sprayed from the nozzles the reaction forces will operate the fan. The nozzles are designed in such a manner that they give the liquid a cohesive and compact jet with maximum thrust. A grid is located between the nozzles and the foam net for atomization and dispersion of the liquid. The air blows the liquid through the foam net thus generating fire-fighting foam.

It is apparent that numerous innovations for foam generators have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a fire fighting adapter for converting a conventional back pack blower into a water and foam fire fighter that avoids the disadvantages of the prior art.

ANOTHER OBJECT of the present invention is to provide a fire fighting adapter for converting a conventional back pack blower into a water and foam fire fighter that is simple to use.

BRIEFLY STATED, STILL ANOTHER OBJECT of the present invention is to provide a fire fighting adapter that converts a conventional back pack blower, which has a discharge tube with a free end through which blown air is provided, into a water and foam fire fighter. The adapter includes a housing and a diffuser unit. The housing attaches to, and communicates with, the free end of the discharge tube of the conventional back pack blower to receive the blown air therefrom. The diffuser unit is contained in the housing, and diffuses the water and the foam to engage with the blown air from the free end of the discharge tube of the conventional back pack blower so as to be propelled by the blown air out of the housing.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 1:
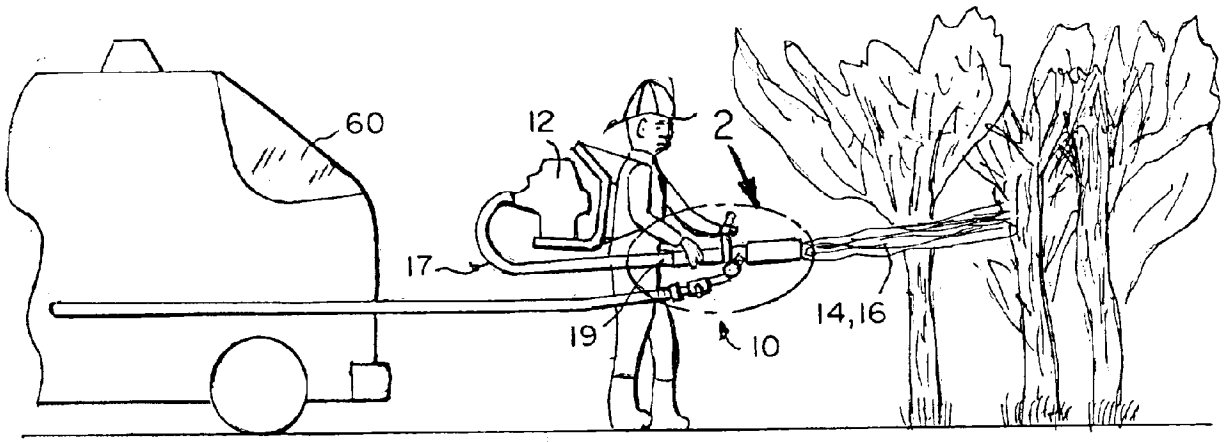
FIG. 1 is a diagrammatic elevational view of the present invention in use.

10 fire fighting adapter of present invention for converting conventional back pack blower 12 into water 14 and foam 16 fire fighter
12 conventional back pack blower
14 water
16 foam
17 discharge tube of conventional back pack blower 12
18 housing for attaching to free end 19 of discharge tube 17 of conventional back pack blower 12 and for receiving blown air therefrom
19 free end of discharge tube 17 of conventional back pack blower 12
20 diffuser unit for diffusing water 14 and foam 16 to engage with blown air from free end 19 of discharge tube 17 of conventional back pack blower 12 so as to be propelled by blown air out of housing 18
22 air discharge tube of housing 18
24 proximal end of air discharge tube 22 of housing 18 for coaxially engaging with free end 19 of discharge tube 17 of conventional back pack blower 12, via ribbed connector 27, and for receiving blown air therefrom
26 distal end of air discharge tube 22 of housing 18
27 ribbed connector of housing 18
28 first portions of pair of snap connectors of air discharge tube 22 of housing 18
30 expansion tube of housing 18
32 proximal end of expansion tube 30 of housing 18
34 free distal discharge end of expansion tube 30 of housing 18
35 second portions of pair of connectors of expansion tube 30 of housing 18
36 handle assembly of housing 18
37 handle of handle assembly 36 of housing 18
38 screw clamp of handle assembly 36 of housing 18
40 diffuser of diffuser unit 20
42 water/foam delivery system of diffuser unit 20
44 water/foam delivery tube of water/foam delivery system 42 of diffuser unit 20
46 proximal end of water/foam delivery tube 44 of water/foam delivery system 42 of diffuser unit 20
48 distal end of water/foam delivery tube 44 of water/foam delivery system 42 of diffuser unit 20
50 pressure gauge of water/foam delivery system 42 of diffuser unit for monitoring water/foam pressure
51 input of pressure gauge 50 of water/foam delivery system 42 of diffuser unit 20
52 on/off control valve of water/foam delivery system 42 of diffuser unit 20
53 output of pressure gauge 50 of water/foam delivery system 42 of diffuser unit 20
54 input of on/off control valve 52 of water/foam delivery system 42 of diffuser unit 20
56 output of on/off control valve 52 of water/foam delivery system 42 of diffuser unit 20
58 swivel hose connector of water/foam delivery system 42 of diffuser unit 20 for connecting to source of water 14 and foam 16, preferably fire engine 60
60 fire engine
62 pair of blades of diffuser 40 of diffuser unit 20
64 proximal end of diffuser 40 of diffuser unit 20
65 longitudinal spaces between adjacent blades of pair of blades 62 of diffuser 40 of diffuser unit 20
66 distal end of diffuser 40 of diffuser unit 20
67 tapering of proximal end 64 of diffuser 40 of diffuser unit 20
68 tube of diffuser 40 of diffuser unit 20
69 terminal end of tube 68 of diffuser 40 of diffuser unit 20
70 void in diffuser 40 of diffuser unit 20
71 terminal of void 70 in diffuser 40 of diffuser unit 20
72 rod of diffuser 40 of diffuser unit 20
73 proximal end of rod 72 of diffuser 40 of diffuser unit 20
74 cone of diffuser 40 of diffuser unit 20

DETAILED DESCRIPTION OF THE PREFERRED EMBODIMENT

Referring now to the figures, in which like numerals indicate like parts, and particularly to FIG. 1, the fire fighting adapter of the present invention is shown generally at 10 for converting a conventional back pack blower 12 into a water 14 and foam 16 fire fighter. The conventional back pack blower 12 has a discharge tube 17 with a free end 19 through which blown air is provided.

Figure 2:
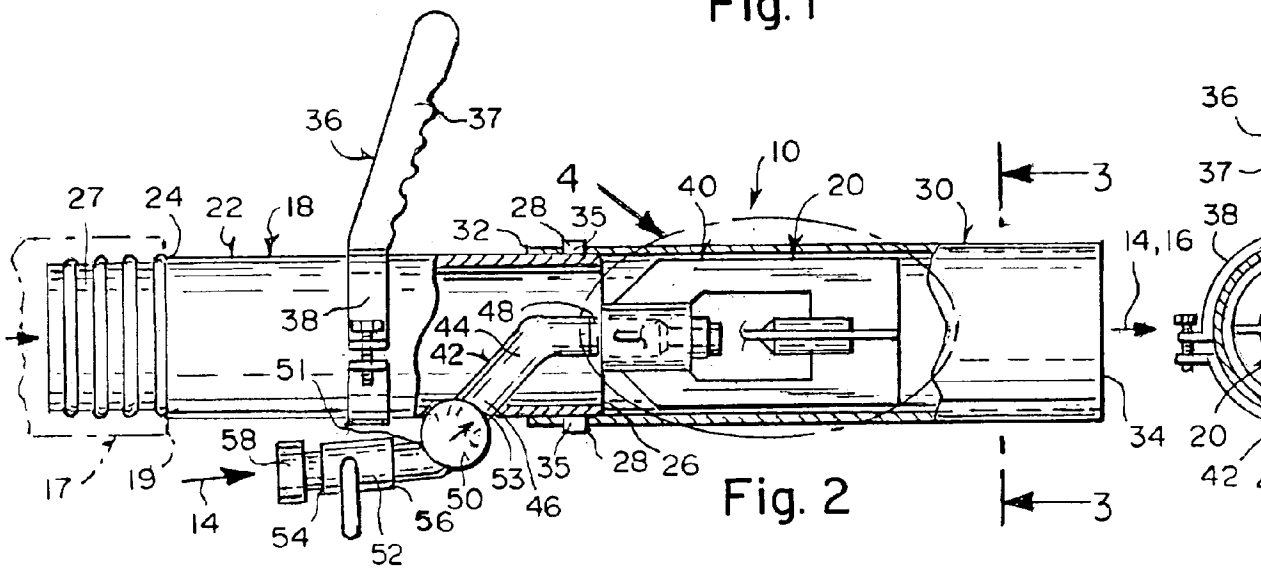
FIG. 2 is an enlarged partially broken away diagrammatic elevational view of the area generally enclosed by the dotted curve identified by arrow 2 in FIG. 1 of the present invention.

The overall configuration of the fire fighting adapter 10 can best be seen in FIG. 2, and as such, will be discussed with reference thereto.

The fire fighting adapter 10 comprises a housing 18 and a diffuser unit 20. The housing 18 is for attaching to, and communicating with, the free end 19 of the discharge tube 17 of the conventional back pack blower 12 and for receiving the blown air therefrom. The diffuser unit 20 is contained in the housing 18, and is for diffusing the water 14 and the foam 16 to engage with the blown air from the free end 19 of the discharge tube 17 of the conventional back pack blower 12 so as to be propelled by the blown air out of the housing 18.

Figure 3:
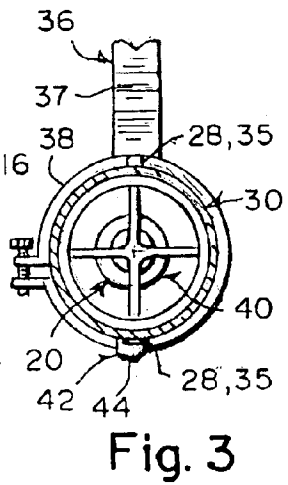
FIG. 3 is a diagrammatic cross sectional view taken along line 3—3 in FIG. 2.

The specific configuration of the housing 18 can best be seen in FIGS. 2 and 3, and as such, will be discussed with reference thereto.

The housing 18 comprises an air discharge tube 22. The air discharge tube 22 has a proximal end 24, a distal end 26, and is made of aluminum for preventing corrosion.

The housing 18 further comprises a ribbed connector 27. The proximal end 24 of the air discharge tube 22 is for coaxially engaging with, and communicating with, the free end 19 of the discharge tube 17 of the conventional back pack blower 12, via the ribbed connector 27, and for receiving the blown air therefrom.

The air discharge tube 22 has first portions of pair of snap connectors 28. The first portions of pair of snap connectors 28 extend radially outwardly from the distal end 26 of the air discharge tube 22, and are diametrically opposed to each other.

The housing 18 further comprises an expansion tube 30. The expansion tube 30 has a proximal end 32, a free distal discharge end 34, and is made of aluminum for preventing corrosion.

The proximal end 32 of the expansion tube 30 coaxially receives, and communicates with, the distal end 26 of the air discharge tube 22, and is for receiving the blown air therefrom.

The expansion tube 30 has second portions of pair of connectors 35. The second portions of pair of connectors 35 extend radially outwardly from the proximal end 26 of the expansion tube 30, are diametrically opposed to each other, and selectively engage with the first portions of pair of snap connectors 28, respectively, so as to allow the expansion tube 30 to selectively snap on and off the air discharge tube 22 and allow the diffuser unit 20 to be exposed and serviced.

The housing 18 further comprises a handle assembly 36. The handle assembly comprises a handle 37 and a screw clamp 38. The handle 37 extends radially outwardly, and slightly forwardly, from the air discharge tube 22, and is maintained thereat, by the screw clamp 38 that depends therefrom and circumferentially engages the air discharge tube 22.

The specific configuration of the diffuser unit 20 can best be seen in FIGS. 2 and 3, and as such, will be discussed with reference thereto.

The diffuser unit 20 comprises a diffuser 40 and a water/foam delivery system 42. The diffuser 40 extends coaxially in the expansion tube 30, and the water/foam delivery system 42 extends through the air discharge tube 22 and communicates with the diffuser 40.

The water/foam delivery system 42 comprises a water/foam delivery tube 44. The water/foam delivery tube 44 has a proximal end 46, a distal end 48, and extends arcuately through the air discharge tube 22, with the proximal end 46 thereof disposed outside the air discharge tube 22 and the distal end 48 thereof disposed coaxially to, and communicating with, the diffuser 40.

The water/foam delivery system 42 further comprises a pressure gauge 50. The pressure gauge 50 has an input 51, an output 53, and is for monitoring water/foam pressure. The output 53 of the pressure gauge 50 is attached to, and communicates with, the proximal end 26 of the water/foam delivery tube 44.

The water/foam delivery system 42 further comprises an on/off control valve 52. The on/off valve 52 has an input 54 and an output 56. The output 56 of the on/off control valve 52 is attached to, and communicates with, the input 51 of the pressure gauge 50.

The water/foam delivery system 42 further comprises a swivel hose connector 58. The swivel hose connector 58 is attached to, and communicates with, the input 54 of the on/off valve 52, and is for connecting to a source of the water 14 and the foam 16, preferably a fire engine 60 (FIG. 1).

Figure 4:
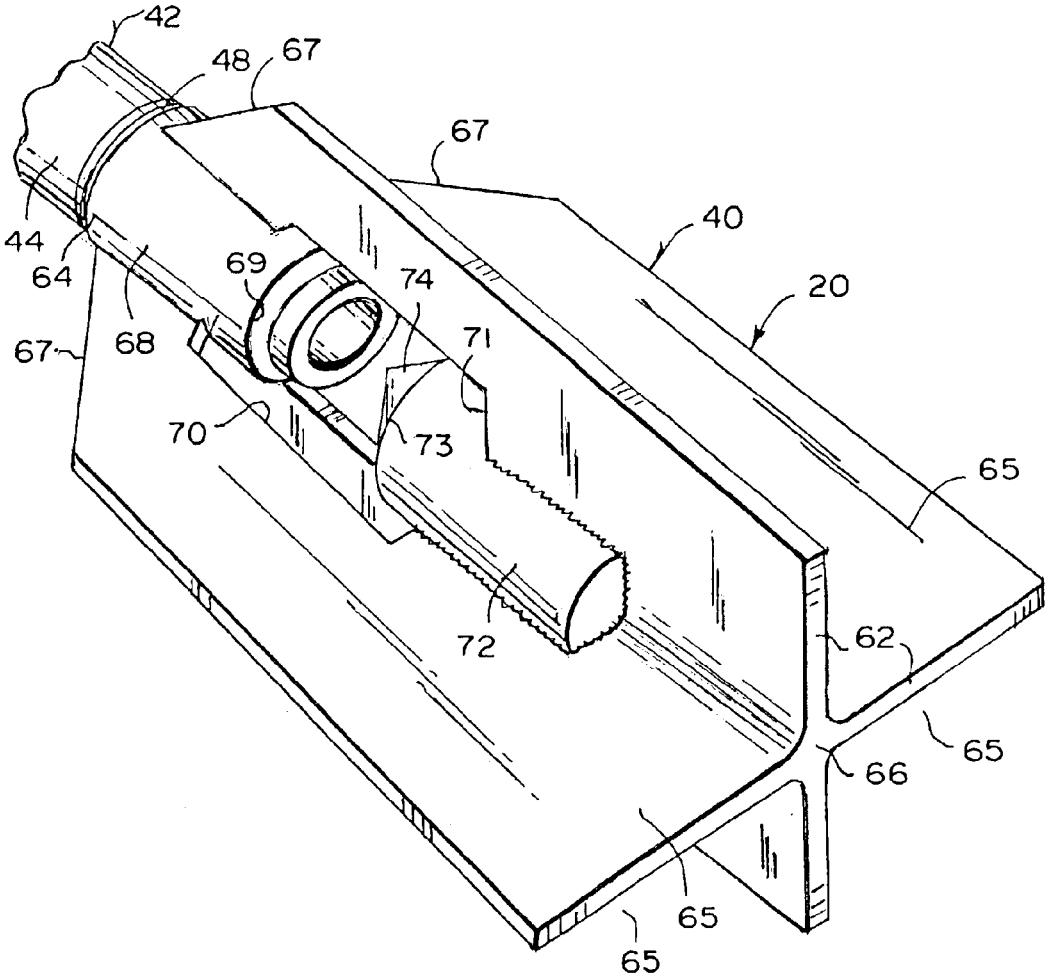
FIG. 4 is an enlarged diagrammatic perspective view of the area generally enclosed by the dotted curve identified by arrow 4 in FIG. 2 of the diffuser unit of the present invention.

The specific configuration of the diffuser 40 can best be seen in FIG. 4, and as such, will be discussed with reference thereto.

The diffuser 40 comprises a pair of blades 62. The pair of blades 62 are plate-like and criss-cross each other perpendicularly to form a proximal end 64 and a distal end 66 of the diffuser 40, and longitudinal spaces 65 between adjacent blades 62, through which the blown air travels from the air discharge tube 22.

The proximal end 64 of the diffuser 40 tapers towards the distal end 66 thereof so as to form tapering 67.

The diffuser 40 further comprises a tube 68. The tube 68 extends coaxially in the proximal end 64 of the diffuser 40 to a terminal end 69 thereof that is slightly forwardly of the tapering 67, and coaxially receives the distal end 48 of the water/foam delivery tube 44.

The diffuser 40 has a void 70. The void 70 is disposed continuously in the pair of blades 62, and extends coaxially from slightly rearwardly of the terminal end 69 of the tube 68 of the diffuser 68 forwardly to a terminal 71 of the void 70 that is short of the distal end 66 of the diffuser 40.

The diffuser 40 further comprises a rod 72. The rod 72 extends coaxially from a proximal end 73 thereof forwardly from slightly rearwardly of the terminal 71 of the void 70, coaxially to the tube 68, to short of the distal end 66 of the diffuser 40.

The diffuser 40 further comprises a cone 74. The cone 74 is disposed coaxially on the proximal end 73 of the rod 72, pointed coaxially towards the tube 68 so as to allow the water 14 and the foam 16 to be propelled by the blown air out of the distal end 34 of the expansion tube 30 by virtue of the water 14 and the foam 16 passing through the water/foam delivery tube 44 and out of the distal end 48 of the water/foam delivery tube 44 into the void 70 where they impact upon the cone 74 and are diffused into the longitudinal spaces 65 to engage with the blown air from the air discharge tube 22.

It will be understood that each of the elements described above, or two or more together, may also find a useful application in other types of constructions differing from the types described above.

While the invention has been illustrated and described as embodied in a fire fighting adapter for converting a conventional back pack blower into a water and foam fire fighter, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A fire fighting adapter for converting a conventional back pack blower into a water and foam fire fighter, wherein the conventional back pack blower has a discharge tube with a free end through which blown air is provided, said adapter comprising:

a) a housing having a air discharge tube with first portions of pair of snap connectors; and b) a diffuser unit;

wherein said housing is for attaching to the free end of the discharge tube of the conventional back pack blower;

wherein said housing is for communicating with the free end of the discharge tube of the conventional back pack blower;

wherein said housing is for receiving the blown air from the free end of the discharge tube of the conventional back pack blower;

wherein said diffuser unit is contained in said housing; and wherein said diffuser unit is for diffusing the water and the foam to engage with the blown air from the free end of the discharge tube of the conventional back pack blower so as to be propelled by the blown air out of said housing.

2. The adapter as defined in claim 1, wherein said air discharge tube has a proximal end; and wherein said air discharge tube has a distal end.

3. The adapter as defined in claim 2, wherein said air discharge tube is made of aluminum for preventing corrosion.

4. The adapter as defined in claim 2, wherein said housing comprises a ribbed connector;

wherein said proximal end of said air discharge tube is for coaxially engaging with the free end of the discharge tube of the conventional back blower via said ribbed connector;

wherein said proximal end of said air discharge tube is for communicating with the free end of the discharge tube of the conventional back pack blower via said ribbed connector; and wherein said proximal end of said air discharge tube is for receiving the blown air from the free end of the discharge tube of the conventional back pack blower.

5. The adapter as defined in claim 2, wherein said first portions of pair of snap connectors extend radially outwardly from said distal end of said air discharge tube; and wherein said first portions of pair of snap connectors are diametrically opposed to each other.

6. The adapter as defined in claim 5, wherein said housing comprises an expansion tube;

wherein said expansion tube has a proximal end; and wherein said expansion tube has a free distal discharge end.

7. The adapter as defined in claim 6, wherein said expansion tube is made of aluminum for preventing corrosion.

8. The adapter as defined in claim 6, wherein said proximal end of said expansion tube coaxially receives said distal end of said air discharge tube;

wherein said proximal end of said expansion tube communicates with said distal end of said air discharge tube;

wherein said proximal end of said expansion tube is for receiving the blown air from said distal end of said air discharge tube.

9. The adapter as defined in claim 6, wherein said expansion tube has second portions of pair of connectors;

wherein said second portions of pair of connectors extend radially outwardly from said proximal end of said expansion tube;

wherein said second portions of pair of connectors are diametrically opposed to each other; and wherein said second portions of pair of connectors selectively engage with said first portions of pair of snap connectors, respectively, so as to allow said expansion tube to selectively snap on and off said air discharge tube and allow said diffuser unit to be exposed and serviced.

10. The adapter as defined in claim 2, wherein said housing comprises a handle assembly;

wherein said handle assembly comprises a handle;

wherein said handle assembly comprises a screw clamp;

wherein said handle extends radially outwardly, and slightly forwardly, from said air discharge tube;

wherein said handle is maintained radially outwardly, and slightly forwardly, from said air discharge tube by said screw clamp;

wherein said screw clamp depends from said handle; and wherein said screw clamp circumferentially engages said air discharge tube.

11. The adapter as defined in claim 6, wherein said diffuser unit comprises a diffuser;

wherein said diffuser unit comprises a water/foam delivery system;

wherein said diffuser extends coaxially in said expansion tube;

wherein said water/foam delivery system extends through said air discharge tube; and wherein said water/foam delivery system communicates with said diffuser.

12. The adapter as defined in claim 11, wherein said water/foam delivery system comprises a water/foam delivery tube;

wherein said water/foam delivery tube has a proximal end;

wherein said water/foam delivery tube has a distal end;

wherein said water/foam delivery tube extends arcuately through said air discharge tube;

wherein said proximal end of said water/foam delivery tube is disposed outside said air discharge tube;

wherein said distal end of said water/foam delivery tube is attached coaxially to said diffuser; and wherein said distal end of said water/foam delivery tube communicates with said diffuser.

13. The adapter as defined in claim 12, wherein said water/foam delivery system comprises a pressure gauge;

wherein said pressure gauge has an input;

wherein said pressure gauge has an output;

wherein said pressure gauge is for monitoring water/foam pressure;

wherein said output of said pressure gauge is attached to said proximal end of said water/foam delivery tube; and wherein said output of said pressure gauge communicates with said proximal end of said water/foam delivery tube.

14. The adapter as defined in claim 13, wherein said water/foam delivery system comprises an on/off control valve;

wherein said on/off valve has an input;

wherein said on/off valve has an output;

wherein said output of said on/off control valve is attached to said input of said pressure gauge; and wherein said output of said on/off control valve communicates with said input of said pressure gauge.

15. The adapter as defined in claim 14, wherein said water/foam delivery system comprises a swivel hose connector;

wherein said swivel hose connector is attached to said input of said on/off valve;

wherein said swivel hose connector communicates with said input of said on/off valve;

wherein said swivel hose connector is for connecting to a source of the water and the foam.

16. The adapter as defined in claim 15, wherein the source of the water and the foam is a fire engine.

17. The adapter as defined in claim 12, wherein said diffuser comprises a pair of blades;

wherein said pair of blades are plate-like;

wherein said pair of blades criss-cross each other perpendicularly to form a proximal end of the diffuser;

wherein said pair of blades criss-cross each other perpendicularly to form a distal end of said diffuser; and wherein said pair of blades criss-cross each other perpendicularly to form longitudinal spaces between adjacent blades, through which the blown air travels from said air discharge tube.

18. The adapter as defined in claim 17, wherein said proximal end of said diffuser tapers towards said distal end thereof so as to form tapering.

19. The adapter as defined in claim 18, wherein said diffuser comprises a tube;

wherein said tube extends coaxially in said proximal end of said diffuser to a terminal end thereof;

wherein said terminal end of said tube is slightly forwardly of said tapering; and wherein said terminal end of said tube coaxially receives said distal end of said water/foam delivery tube.

20. The adapter as defined in claim 19, wherein said diffuser has a void;

wherein said void is disposed continuously in said pair of blades;

wherein said void extends coaxially from slightly rearwardly of said terminal end of said tube of said diffuser forwardly to a terminal of said void; and wherein said terminal end of said void is short of said distal end of said diffuser.

21. The adapter as defined in claim 20, wherein said diffuser comprises a rod;

wherein said rod extends coaxially from a proximal end thereof, forwardly from slightly rearwardly of said terminal of said void to short of said distal end of said diffuser; and wherein said rod extends coaxially to said tube.

22. The adapter as defined in claim 21, wherein said diffuser comprises a cone;

wherein said cone is disposed coaxially on said proximal end of said rod; and wherein said cone is pointed coaxially towards said tube so as to allow the water and the foam to be propelled by the blown air out of said distal end of said expansion tube by virtue of the water and the foam passing through said water/foam delivery tube into said void where they impact upon said cone and are diffused into said longitudinal spaces to engage with the blown air from said air discharge tube.

* * * * *